US009979121B2

(12) United States Patent
Reimann et al.

(10) Patent No.: US 9,979,121 B2
(45) Date of Patent: May 22, 2018

(54) ELECTRICAL PLUG-TYPE CONNECTOR PART

(71) Applicant: Kostal Kontakt Systeme GmbH, Luedenscheid (DE)

(72) Inventors: Daniel Reimann, Schwerte (DE); Volker Thurau, Dortmund (DE)

(73) Assignee: Kostal Kontakt Systeme GmbH, Luedenscheid (DE)

( * ) Notice: Subject to any disclaimer, the term of this patent is extended or adjusted under 35 U.S.C. 154(b) by 0 days. days.

(21) Appl. No.: 15/687,740

(22) Filed: Aug. 28, 2017

(65) Prior Publication Data

US 2017/0358888 A1 Dec. 14, 2017

Related U.S. Application Data

(63) Continuation of application No. PCT/EP2016/058893, filed on Apr. 21, 2016.

(30) Foreign Application Priority Data

Apr. 24, 2015 (DE) ..... 10 2015 005 282

(51) Int. Cl.
*H01R 29/00* (2006.01)
*H01R 13/58* (2006.01)
(Continued)

(52) U.S. Cl.
CPC ..... *H01R 13/5812* (2013.01); *H01R 13/4361* (2013.01); *H01R 13/506* (2013.01);
(Continued)

(58) Field of Classification Search
CPC ..... H01R 27/00; H01R 13/635; H01R 13/633
(Continued)

(56) References Cited

U.S. PATENT DOCUMENTS 4,998,896 A * 3/1991 Lundergan ..... H01R 13/4365 439/274
5,618,201 A * 4/1997 Yagi ..... H01R 13/6275 439/188
(Continued)

FOREIGN PATENT DOCUMENTS

DE 2829639 B1 11/1979
DE 10209566 A1 1/2003
(Continued)

OTHER PUBLICATIONS

European Patent Office, International Search Report for the corresponding International Application No. PCT/EP2016/058893, dated Jun. 27, 2016.
(Continued)

*Primary Examiner* — Phuong Chi T Nguyen
(74) *Attorney, Agent, or Firm* — Brooks Kushman P.C.

(57) ABSTRACT

An electrical plug-type connector part includes a contact carrier, a protective housing, and a clamping bracket. The contact carrier has chambers for receiving contact elements connected to electrical connection lines. The protective housing is engaged over the contact carrier and has passage openings receiving the electrical connection lines. The clamping bracket is attachable to the protective housing and has elastic spring arms corresponding to the passage openings in the protective housing. When the clamping bracket is attached to the protective housing the spring arms extend into the passage openings and resiliently press the electrical connection lines received in the passage openings against an inner wall of the protective housing for the clamping bracket to thereby fix the electrical connection lines to the protective housing in a clamping manner.

19 Claims, 4 Drawing Sheets

(51) Int. Cl.
*H01R 13/506* (2006.01)
*H01R 13/436* (2006.01)
*H01R 24/20* (2011.01)

(52) U.S. Cl.
CPC ..... *H01R 13/582* (2013.01); *H01R 13/5837* (2013.01); *H01R 24/20* (2013.01); *H01R 2201/26* (2013.01)

(58) Field of Classification Search
USPC ..... 439/668, 188, 669, 944
See application file for complete search history.

(56) References Cited

U.S. PATENT DOCUMENTS

| | | | | |
|---|---|---|---|---|
| 5,672,073 | A * | 9/1997 | Matsumura | H01R 13/641 439/188 |
| 6,280,262 | B1 | 8/2001 | Tanaka | |
| 6,568,948 | B2 * | 5/2003 | Matsuoka | H01R 13/4361 439/271 |

FOREIGN PATENT DOCUMENTS

| | | | |
|---|---|---|---|
| DE | 102008018758 | A1 | 10/2009 |
| DE | 102008055841 | A1 | 5/2010 |
| JP | 2009146768 | A | 7/2009 |

OTHER PUBLICATIONS

German Patent Office, German Search Report for the corresponding German Patent Application No. 10 2015 005 282.9 dated Dec. 9, 2015.

* cited by examiner

ELECTRICAL PLUG-TYPE CONNECTOR PART

CROSS-REFERENCE TO RELATED APPLICATIONS

This application is a continuation of International Application No. PCT/EP2016/058893, published in German, with an International filing date of Apr. 21, 2016, which claims priority to DE 10 2015 005 282.9, filed Apr. 24, 2015; the disclosures of which are hereby incorporated in their entirety by reference herein.

TECHNICAL FIELD

The present invention relates to an electrical plug-type (plug-in) connector part having a contact carrier, a protective housing, and a clamping bracket in which the contact carrier has receiving chambers for electrical plug-type contact elements connected to respective electrical connection lines, the protective housing at least partially covers the contact carrier and forms passage openings for the electrical connection lines, and the clamping bracket is attachable to the protective housing in a locking manner and fixes the electrical connection lines to the protective housing in a clamping manner after the attachment is made.

BACKGROUND

DE 10 2008 018 758 A1 describes a plug-in connector having a sealing unit with at least one receiving recess for accommodating a contact and/or a cable. The plug-in connector has a closing mechanism for reducing a cross-section of the receiving recess to the seal cross-section after the contact and/or the cable are/is introduced into the receiving recess.

One disadvantage of many plug-in connector parts is that the connections between plug-in contact elements and electrical connection lines are mechanically stressed by vibratory influences such as vibrations in a motor vehicle. Over time, the electrical connections between the connection lines and the plug-in contact elements may thus deteriorate or even fail completely.

The plug-in connector described in DE 10 2008 018 758 A1 allows fastening of connection lines in the receiving recesses by the closing mechanism. However, this assumes that the cross-sectional width of the connection lines is well-adapted to the width of the receiving recesses. Although the elastic properties of a sealing unit made of an elastomer allow a certain tolerance compensation with regard to the cable cross-section, this is however only to a relatively small extent.

If the cross-sectional width of a connection line is much smaller than the provided dimension, then the connection line is no longer tightly enclosed by the elastomeric material of the sealing unit and therefore is not securely fastened. On the other hand, if the cross-sectional width of a connection line is much larger than the provided dimension, then closing of the closing mechanism is made more difficult or impossible. The plug-in connector described in DE 10 2008 018 758 A1 therefore provides one cross-sectional width for the connection lines, and allows only relatively small deviations therefrom.

DE 10 2008 055 841 A1 describes a plug-in connector in which sections of electrical connection lines are enclosed between a housing body and an attachable housing part in a form-fit manner. The plug-in connector also requires connection lines having a precisely specified cross-section. If the connection lines are thinner than specified, then they are no longer enclosed in the form-fit manner and thus not protected against vibration between the housing body and the housing part. Connection lines having a larger cross-section than specified cannot be used because, due to the precise shape adaptation, the housing part can no longer be tightly connected to the housing body.

In many applications, control and power signals which correspond to current intensities of various orders of magnitude are led across the contacts of multi-pole plug-in connectors. Accordingly, electrical connection lines having greatly different line cross-sections are advantageous for conducting such different current intensities.

SUMMARY

An object is an easily and cost-effectively manufactural electrical plug-type connector part that allows simple installation, and at the same time, vibration-resistant fastening of electrical connection lines having greatly different line cross-sections.

In carrying out at least one of the above and/or other objects, an electrical plug-type connector part is provided. The connector part includes a contact carrier, a protective housing, and a clamping bracket. The contact carrier has chambers for receiving contact elements connected to electrical connection lines. The protective housing is engaged over the contact carrier and having passage openings receiving the electrical connection lines. The clamping bracket is attachable to the protective housing and has integrally formed elastic spring arms corresponding to the passage openings in the protective housing. When the clamping bracket is attached to the protective housing the spring arms extend into the passage openings and resiliently press the electrical connection lines received in the passage openings against an inner wall of the protective housing for the clamping bracket to thereby fix the electrical connection lines to the protective housing in a clamping manner.

An embodiment provides an electrical plug-type connector part having a contact carrier, a protective housing, and a clamping bracket. The contact carrier has receptacle chambers for electrical plug-type contact elements. The plug-type contact elements are respectively connected to electrical connection lines. The protective housing engages over the contact carrier at least in sections. The protective housing forms passage openings for the electrical connection lines. The clamping bracket is joinable to the protective housing in a latching manner. The clamping bracket fixes the electrical connection lines to the protective housing in a clamping manner after the joining process. The clamping bracket has an integrally formed elastic spring arm for each passage opening in the protective housing. The spring arms, after being fitted to the protective housing, press respective electrical connection lines guided through the passage openings of the protective housing against an inner wall of the protective housing in a resilient manner.

In embodiments, the clamping bracket has an integrally formed elastic spring arm for each passage opening in the protective housing. Each spring arm, after assembly to the protective housing, resiliently presses an electrical connection line, which is guided through a passage opening of the protective housing, against an inner wall of the protective housing.

In an embodiment, to achieve simple installation of the clamping bracket on the protective housing and easy fixing of the connection lines, the clamping bracket is connectable to the protective housing in a latching manner.

In an embodiment, the clamping bracket may be positioned on the protective housing in two locking (or latching) positions. The clamping bracket may thus initially be pre-mounted on the protective housing in a pre-locking position in which the spring arms of the clamping bracket do not yet extend into the passage openings of the protective housing. The plug-type contact elements may thus be passed through the passage openings and inserted into the receiving chambers of the contact carrier. The insertion may take place either manually or in a completely automated manner. After the connection lines are aligned in the passage openings, pressure is exerted on the clamping bracket to move the clamping bracket from its pre-locking position into an end locking position. In the end locking position the spring arms engage against the connection lines and press the connection lines against inner walls of the protective housing. The connection lines are thus locked in the passage openings in the protective housing in a force-fit manner.

In an embodiment, the clamping bracket has an essentially straight bracket strip having a detent hook integrally formed on each of its end sections. Multiple spring arms are integrally formed on the bracket strip. Each spring arm forms a first section and a second section. The two sections extend approximately perpendicularly with respect to one another and merge into one another in a rounded manner. The two sections are both aligned essentially perpendicularly with respect to the longitudinal axis of the bracket strip.

In an embodiment, for stable fastening of the connection lines, the spring arms of the clamping bracket form an integrally formed hollow cavity (e.g., a shaped hollow flank) on their side facing the connection lines.

Use of the plug-type connector part in accordance with the embodiments is particularly advantageous in environments in which the connector part is exposed to stresses from vibrations such as, for example, in motor vehicles.

BRIEF DESCRIPTION OF THE DRAWINGS

An exemplary embodiment of an electrical plug-type connector part in accordance with the present invention is illustrated in the drawings and explained in greater detail below. The drawings include the following.

DETAILED DESCRIPTION

Detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of components. Therefore, specific structural and functional details disclosed herein are not to be interpreted as limiting, but merely as a representative basis for teaching one skilled in the art to variously employ the present invention.

Figure 1:
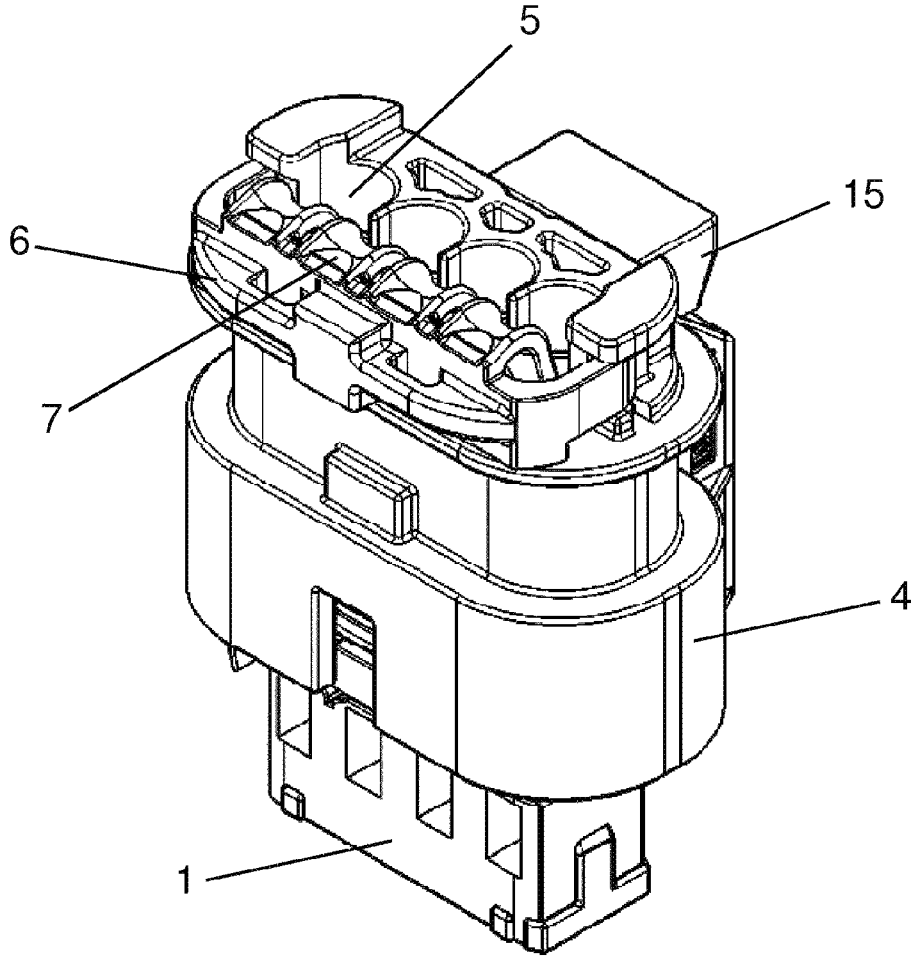
FIG. 1 illustrates an electrical plug-type connector part in accordance with an embodiment of the present invention.
Figure 2:
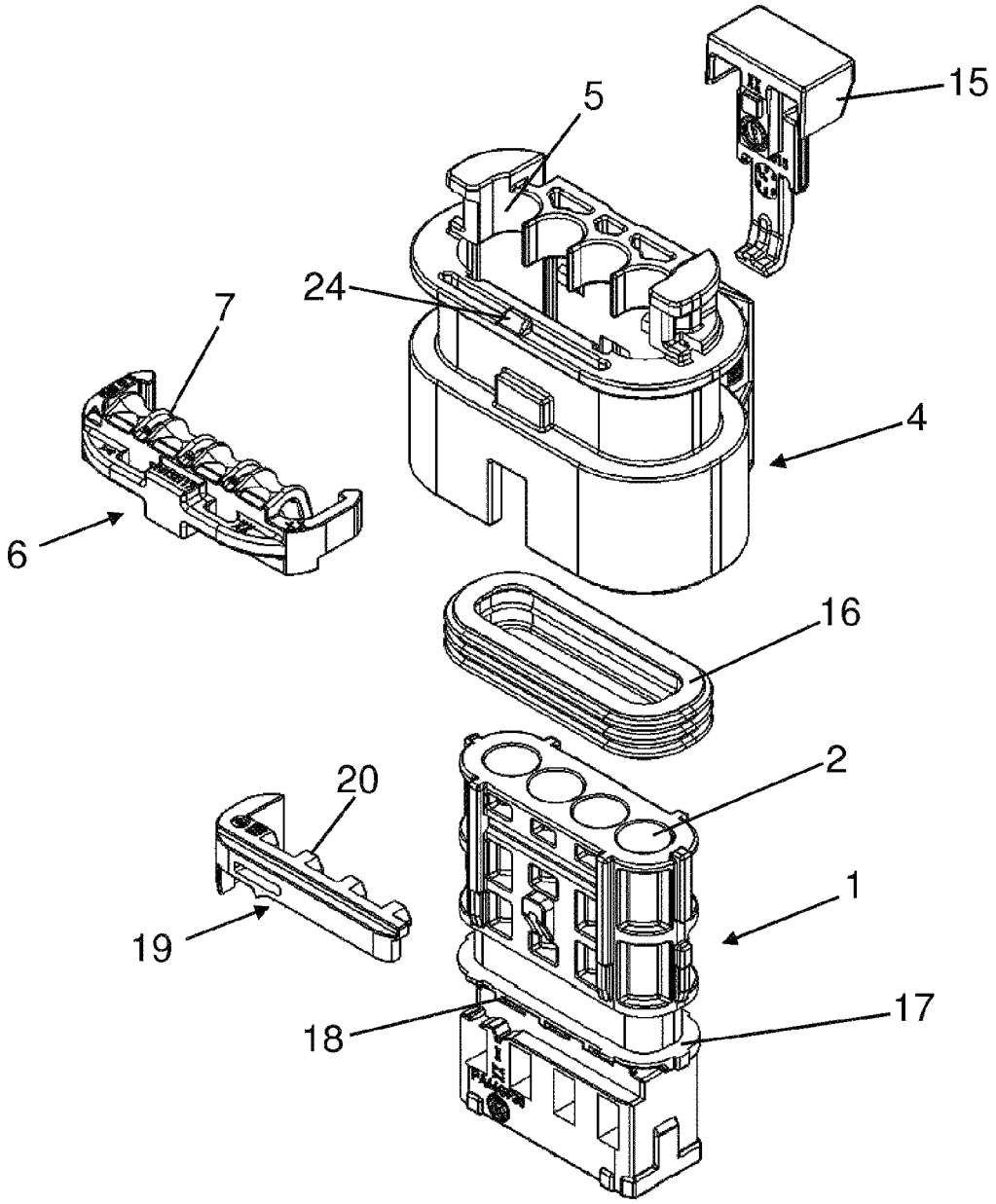
FIG. 2 illustrates an exploded view of the connector part.

Referring now to FIGS. 1 and 2, a perspective and an exploded view of an electrical plug-type (plug-in) connector part in accordance with an embodiment of the present invention are shown, respectively. Plug-type contact elements (not shown) are connected to electrical connection lines. Push-on sleeves or plug pins may be provided as the contact elements. As such, the connector part may form either a female plug socket or a male plug.

The connector part has a contact carrier 1 and a protective housing 4. An annular seal 16 is situated between contact carrier 1 and protective housing 4. Seal 16 rests on a circumferential shoulder 17 on contact carrier 1. Seal 16 encloses the periphery of contact carrier 1. Seal 16 seals the power-side portion of the connector part with respect to an attachable mating connector part (not shown) in a moisture-tight manner. The coupling of the mutually connectable connector parts is secured by a housing lock. The housing lock as part of the connector part includes a housing latch 15 integrally formed or fastened on protective housing 4.

Contact carrier 1 includes receiving chambers 2. Receiving chambers 2 are configured to respectively receive contact elements. The contact elements, which may be or art to be connected to respective electrical connection lines extending through passage openings 5 of protective housing 4, insert into respective ones of receiving chambers 2.

A secondary latch 19 is used for fastening contact elements received in receiving chambers 2. Secondary latch 19 is lockable to the outer wall of contact carrier 1. Secondary latch 19 includes locking pins 20 integrally formed thereon. While secondary latch 19 is attached to contact carrier 1, locking pins 20 respectively engage with openings 18 on the contact carrier and mechanically lock the contact elements resting in receiving chambers 2 of the contact carrier.

Contact carrier 1 forms multiple, e.g., four, receiving chambers 2 for multiple, e.g., four, contact elements. Connection lines 3 (shown FIG. 6) connected to the contact elements are led out from the connector part through passage openings 5 on protective housing 4.

The connector part further includes a clamping bracket 6. Clamping bracket 6 latches or snaps onto protective housing 4. While clamping bracket 6 is attached onto protective housing 4, the clamping bracket secures connection lines 3 that are connected to the contact elements resting in receiving chambers 2 of contact carrier 1.

For securing connection lines 3, clamping bracket 6 has integrally formed spring arms 7. Spring arms 7 respectively correspond to passage openings 5 of protective housing 4. Spring arms 7 resiliently press connection lines 3 led through passage openings 5 against an inner wall 14 of protective housing 4.

Figure 3:
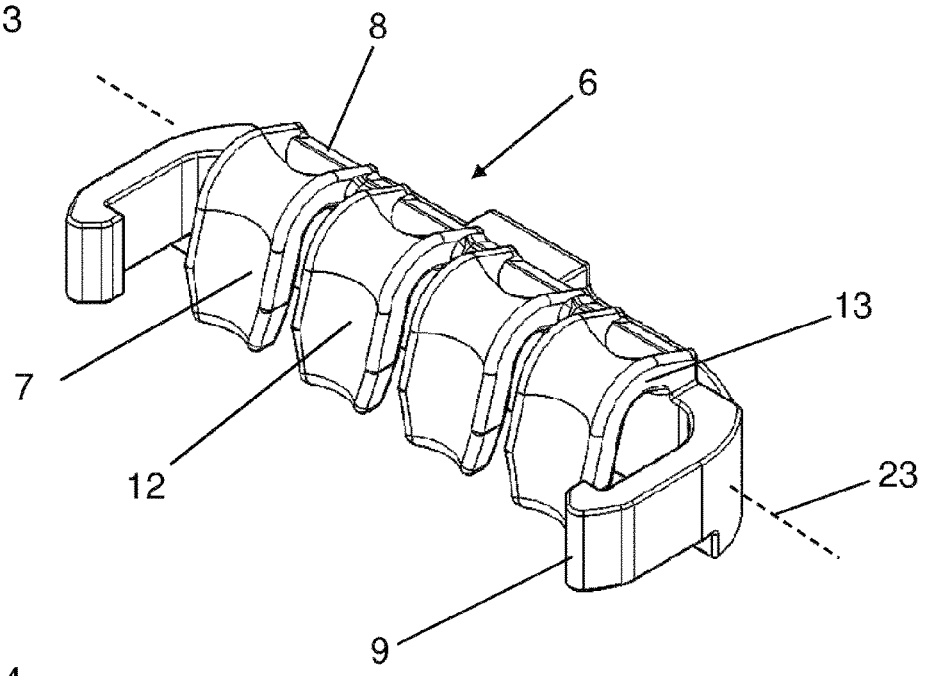
FIG. 3 illustrates a perspective view of a clamping bracket of the connector part.
Figure 4:
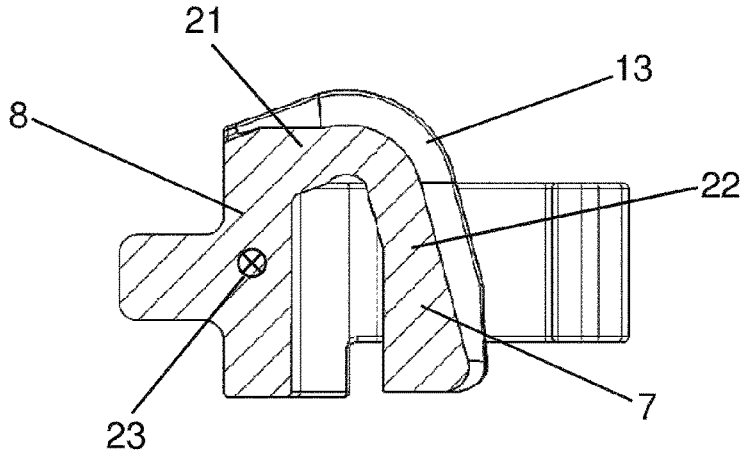
FIG. 4 illustrates a sectional view of the clamping bracket.

FIGS. 3 and 4 further illustrate clamping bracket 6 and its spring arms 7. FIG. 3 illustrates clamping bracket 6 as an individual part. Clamping bracket 6 is formed in one piece. Clamping bracket 6 has a straight or slightly arched bracket strip (i.e., guide bar) 8. A pair of detent hooks (i.e., latching hooks) 9 are integrally formed on respective ends of bracket strip 8. Four spring arms 7 are integrally formed in one piece on the top side of bracket strip 8.

FIG. 4 illustrates a sectional view of one of spring arms 7. As shown in FIG. 4, spring arm 7 includes a first section 21 and a second section 22. First section 21 is integrally formed perpendicularly on bracket strip 8. First section 21 merges into second section 22. Second section 22 is oriented approximately at a right angle with respect to first section 21. Both sections 21 and 22 are oriented perpendicularly with respect to a longitudinal axis 23 of bracket strip 8. The course of longitudinal axis 23 is indicated by a dashed line in FIG. 3. As also shown in FIGS. 3 and 4, the convex upper sides of spring arms 7 each have elevated shoulder-like side edges 13. The surfaces of spring arms 7 between side edges 13 in each case form a hollow cavity (i.e., a hollow flute) 12.

Figure 5:
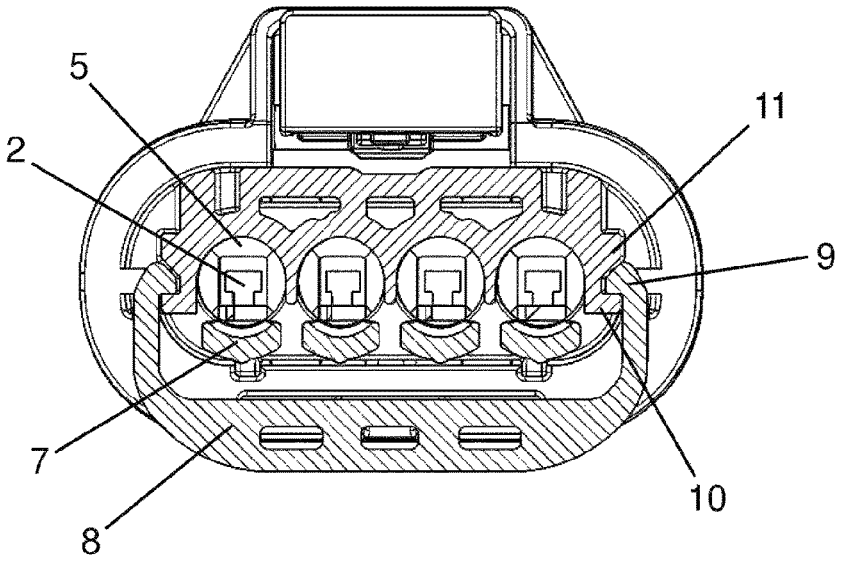
FIG. 5 illustrates a sectional view of the connector part.

FIG. 5 illustrates the latching connection between clamping bracket 6 and protective housing 4. A section which is guided perpendicularly with respect to the longitudinal direction of the connector part is illustrated. The section extends at approximately the level of longitudinal axis 23 of bracket strip 8 illustrated in FIGS. 3 and 4.

As shown in FIG. 5, the two detent hooks 9 of clamping bracket 6 are latched or engaged behind first detent projections (i.e., first latching projections) 10 on protective housing 4. Clamping bracket 6 is thus situated on protective housing 4 in a pre-locking position. In this pre-locking position, spring arms 7 of clamping bracket 6 are not yet engaged with (i.e., do not yet extend into) passage openings 5 in protective housing 4. In the pre-locking position, it is thus possible to equip the connector part with contact elements manually or in a completely automated manner. This can be done by inserting the contact elements, together with connection lines 3 connected to the contact elements, into passage openings 5 in protective housing 4 and pushing them into receiving chambers 2 of contact carrier 1.

When all provided contact elements are inserted into receiving chambers 2 of contact carrier 1 they are thus fastened to the contact carrier in the receiving chambers due to the locking attachment of secondary latch 19 to the outer wall of the contact carrier. Connection lines 3 led out from passage openings 5 in protective housing 4 are subsequently fixed to the protective housing by applying pressure to the outer side of bracket strip 8 of clamping bracket 6. Consequently, clamping bracket 6 goes from its pre-locking position into its end locking position, in which the detent hooks 9 are engaged behind second detent projections (i.e., second latching projections) 11 on protective housing 4. For assisting with the locking to protective housing 4, an elastically attached detent cam 24 (shown in FIG. 2) may be provided. Detent cam 24 additionally fixes clamping bracket 6 in the end locking position from behind.

Figure 6:
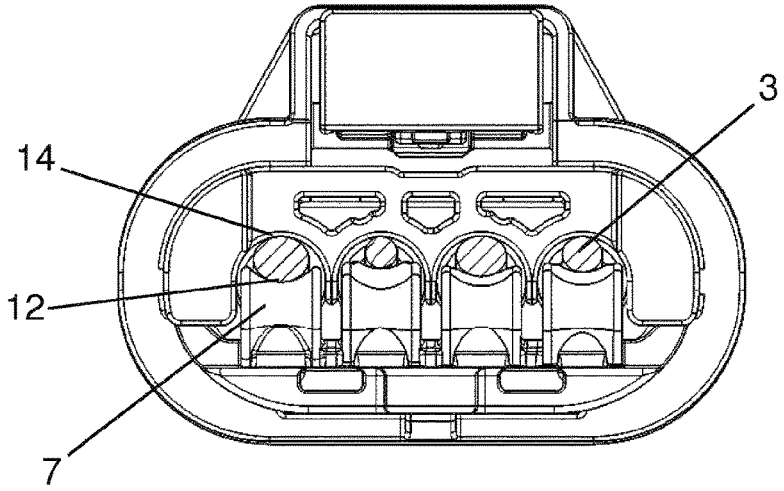
FIG. 6 illustrates a view of the connector part with attached electrical connection lines.

The assembled state illustrated in FIG. 6 of the connector part is thus established. In the illustrated end locking position, clamping bracket 6 is drawn closely against protective housing 4. Consequently, spring arms 7 of clamping bracket 6 engage with passage openings 5 of protective housing 4 and rest against connection lines 3. Connection lines 3 are thus pressed against inner wall 14 of protective housing 4 due to the spring force of spring arms 7 and are thus fastened in passage openings 5 in a force-fit manner.

The sides of spring arms 7 of clamping bracket 6 facing connection lines 3 each form a hollow cavity 12. Connection lines 3 are thus enclosed in sections in an arch shape by the rounded inner walls 14 of protective housing 4 and spring arms 7 and are thus held with precise positioning in passage openings 5 of the protective housing.

FIG. 6 shows four connection lines 3 having different cross-sectional widths. Connection lines 3 are fixed in respective passage openings 5 of protective housing 4. Connection lines 3 having larger cross-sectional widths deflect spring arms 7 more strongly toward bracket strip 8 than connection lines 3 having smaller cross-sectional widths. This results in the advantageous, desired effect that connection lines 3 having the larger cross-section, and thus being heavier, are fixed by spring arms 7 with a greater restoring spring force than the more lightweight connection lines 3 having a smaller cross-section. Spring arms 7 thus fit well to different cross-sectional widths of different connection lines 3 and at the same time generate a retaining force that is adequate in each case for each connection line.

LIST OF REFERENCE NUMERALS

1 contact carrier
2 receiving chamber(s) of the contact carrier
3 electrical connection line(s)
4 protective housing
5 passage opening(s) of the protective housing
6 clamping bracket
7 spring arm(s) of the clamping bracket
8 bracket strip of the clamping bracket
9 detent hooks of the bracket strip of the clamping bracket
10 first detent projections on the protective housing
11 second detent projections on the protective housing
12 hollow cavity of a spring arm
13 side edges of the spring arms
14 inner wall of the protective housing
15 housing latch
16 seal
17 shoulder on the contact carrier
18 openings of the contact carrier
19 secondary latch
20 locking pins
21 first section of the spring arm
22 second section of the spring arm
23 longitudinal axis of the bracket strip of the clamping bracket
24 detent cam While exemplary embodiments are described above, it is not intended that these embodiments describe all possible forms of the present invention. Rather, the words used in the specification are words of description rather than limitation, and it is understood that various changes may be made without departing from the spirit and scope of the present invention. Additionally, the features of various implementing embodiments may be combined to form further embodiments of the present invention.

What is claimed is:

1. An electrical plug-type connector part comprising:

a contact carrier having chambers for receiving contact elements connected to electrical connection lines;

a protective housing engaged over the contact carrier and having passage openings receiving the electrical connection lines; and a clamping bracket attachable to the protective housing and having integrally formed elastic spring arms corresponding to the passage openings in the protective housing, wherein when the clamping bracket is attached to the protective housing the spring arms extend into the passage openings and resiliently press the electrical connection lines received in the passage openings against an inner wall of the protective housing for the clamping bracket to thereby fix the electrical connection lines to the protective housing in a clamping manner;

wherein the clamping bracket has a bracket strip having a pair of detent hooks integrally formed on respective end sections of the bracket strip;

wherein the spring arms are the elastic deform fingers.

2. The electrical plug-type connector part of claim 1 further comprising a secondary latch configured to snap onto an outer side of the contact carrier to fix the contact elements in the contact carrier.

3. The electrical plug-type connector part of claim 1 wherein the electrical plug-in connector part is for use in a motor vehicle.

4. The electrical plug-type connector part of claim 1 wherein the electrical connection lines have at least two different cross-sectional widths.

5. The electrical plug-type connector part of claim 1, wherein the spring arms are integrally formed on the bracket strip, each spring arm forms a first section and a second section which extend perpendicularly with respect to one another and merge into one another in a rounded manner, the first section and the second section are aligned perpendicularly with respect to a longitudinal axis of the bracket strip.

6. The electrical plug-type connector part of claim 5 wherein each spring arm has a hollow cavity facing a corresponding electrical connection line to resiliently press the electrical connection line.

7. The electrical plug-type connector part of claim 6 wherein each spring arm further includes a pair of shoulder edges, wherein the hollow cavity of a spring arm is between the shoulder edges of the spring arm.

8. The electrical plug-type connector part of claim 1 wherein the clamping bracket is lockable to the protective housing.

9. The electrical plug-type connector part of claim 8 wherein the clamping bracket is positionable on the protective housing in a pre-locking position and an end locking position.

10. The electrical plug-type connector part of claim 9 wherein in the pre-locking position the spring arms are positioned such that the spring arms do not extend into the passage openings.

11. The electrical plug-type connector part of claim 9 wherein in the end locking position the spring arms extend into the passage openings.

12. A connector comprising:

a contact carrier having chambers receiving contact elements connected to electrical connection lines;

a housing engaged over the contact carrier and having passages receiving the electrical connection lines; and a clamp attachable to the housing in a pre-locking position and an end locking position, the clamp having elastic spring arms corresponding to the passages in the housing, wherein when the clamp is attached to the housing in the pre-locking position the spring arms are out of the passages, wherein when the clamp is attached to the housing in the end locking position the spring arms extend into the passages and resiliently press the electrical connection lines received in the passages against an inner wall of the housing so that the clamp fixes the electrical connection lines to the housing in a clamping manner;

wherein the clamping bracket has a bracket strip having a pair of detent hooks integrally formed on respective end sections of the bracket strip;

wherein the spring arms are the elastic deform fingers.

13. The connector of claim 12 further comprising a secondary latch attachable to an outer side of the contact carrier to fix the contact elements in the contact carrier.

14. The connector of claim 12 wherein the electrical connection lines have at least two different cross-sectional widths.

15. The connector of claim 12 wherein the clamp has a bracket strip having the spring arms.

16. The connector of claim 15 wherein the hooks configured for attaching the clamp to the housing.

17. The connector of claim 15 wherein each spring arm includes a first section and a second section which extend perpendicularly with respect to one another and merge into one another in a rounded manner and which are aligned perpendicularly with respect to a longitudinal axis of the bracket strip.

18. The connector of claim 15 wherein each spring arm has a hollow cavity which faces a corresponding electrical connection line for the spring arm to resiliently press the electrical connection lines passages against the inner wall of the housing.

19. The connector of claim 18 wherein each spring arm further includes a pair of shoulder edges, wherein the hollow cavity of a spring arm is between the shoulder edges of the spring arm.

* * * * *